US009550271B2

(12) United States Patent
Yasuda et al.

(10) Patent No.: US 9,550,271 B2
(45) Date of Patent: Jan. 24, 2017

(54) SUBSTRATE HOLDING APPARATUS AND POLISHING APPARATUS

(71) Applicant: EBARA CORPORATION, Tokyo (JP)

(72) Inventors: Hozumi Yasuda, Tokyo (JP); Makoto Fukushima, Tokyo (JP); Osamu Nabeya, Tokyo (JP); Masahiko Kishimoto, Tokyo (JP)

(73) Assignee: Ebara Corporation, Tokyo (JP)

( * ) Notice: Subject to any disclaimer, the term of this patent is extended or adjusted under 35 U.S.C. 154(b) by 24 days.

(21) Appl. No.: 14/599,976

(22) Filed: Jan. 19, 2015

(65) Prior Publication Data

US 2015/0202733 A1 Jul. 23, 2015

(30) Foreign Application Priority Data

Jan. 21, 2014 (JP) ..... 2014-008286

(51) Int. Cl.
*B24B 37/32* (2012.01)
*B24B 7/22* (2006.01)
*B24B 37/10* (2012.01)

(52) U.S. Cl.
CPC ..... *B24B 37/32* (2013.01); *B24B 37/107* (2013.01)

(58) Field of Classification Search
CPC ..... B24B 37/32; B24B 37/107; H01L 21/304; H01L 2221/67
USPC ..... 451/398, 388, 287, 288, 289, 290, 41
See application file for complete search history.

(56) References Cited

U.S. PATENT DOCUMENTS 6,848,980 B2 * 2/2005 Chen ..... B24B 37/32 451/285
7,255,637 B2 * 8/2007 Bennett ..... B24B 37/32 451/286
2010/0273405 A1 10/2010 Fukushima et al.
2013/0324012 A1 12/2013 Fukushima et al.

FOREIGN PATENT DOCUMENTS

WO WO 01/87541 A2 11/2001

* cited by examiner

*Primary Examiner* — Robert Rose
(74) *Attorney, Agent, or Firm* — Baker & Hostetler LLP

(57) ABSTRACT

A substrate holding apparatus and a polishing apparatus which can reduce vibrations of a top ring in its entirety by damping vibrations transmitted from a retaining ring to a top ring body is disclosed. The substrate holding apparatus includes a top ring body having a substrate holding surface configured to hold and press a substrate against a polishing surface, a retaining ring configured to surround the substrate and to contact the polishing surface, and a drive ring comprising a ring member configured to hold the retaining ring on a lower surface thereof, a central member disposed at a central part of the top ring body and supported by the top ring body, and a connecting portion configured to connect the ring member and the central member. The drive ring includes a first material and a second material having a modulus of longitudinal elasticity smaller than the first material.

22 Claims, 11 Drawing Sheets

SUBSTRATE HOLDING APPARATUS AND POLISHING APPARATUS

CROSS REFERENCE TO RELATED APPLICATION

This document claims priority to Japanese Patent Application Number 2014-008286 filed Jan. 21, 2014, the entire contents of which are hereby incorporated by reference.

BACKGROUND

With a recent trend toward higher integration and higher density in semiconductor devices, circuit interconnects become finer and finer and the number of levels in multilayer interconnect is increasing. In the fabrication process of the multilayer interconnect with finer circuit, as the number of interconnect levels increases, film coverage (or step coverage) of step geometry is lowered in thin film formation because surface steps grow while following surface irregularities on a lower layer. Therefore, in order to fabricate the multilayer interconnect, it is necessary to improve the step coverage and planarize the surface. It is also necessary to planarize semiconductor device surfaces so that irregularity steps formed thereon fall within a depth of focus in optical lithography. This is because finer optical lithography entails shallower depth of focus.

Accordingly, the planarization of the semiconductor device surfaces is becoming more important in the fabrication process of the semiconductor devices. Chemical mechanical polishing (CMP) is the most important technique in the surface planarization. This chemical mechanical polishing is a process of polishing a wafer by bringing the wafer in sliding contact with a polishing surface of a polishing pad while supplying a polishing liquid containing abrasive particles, such as silica ($SiO_2$), onto the polishing surface.

A polishing apparatus for performing CMP has a polishing table that supports the polishing pad thereon, and a substrate holding apparatus, which is called a top ring or a polishing head, for holding a substrate such as a wafer. In the case where the substrate is polished using such polishing apparatus, the substrate holding apparatus holds the substrate and presses it against the polishing surface of the polishing pad at a predetermined pressure. At this time, the polishing table and the substrate holding apparatus are moved relative to each other to bring the substrate into sliding contact with the polishing surface to thereby polish a surface of the substrate.

When polishing the substrate, if a relative pressing force applied between the substrate and the polishing surface of the polishing pad is not uniform over the entire surface of the substrate, insufficient polishing or excessive polishing would occur depending on the pressing force applied to each portion of the substrate. Thus, in order to uniformize the pressing force applied to the substrate, the substrate holding apparatus has a pressure chamber formed by a membrane (elastic membrane) at a lower part thereof. This pressure chamber is supplied with a fluid, such as air, to press the substrate through the membrane under a fluid pressure.

However, because the above-described polishing pad has elasticity, the pressing force becomes non-uniform in an edge portion (peripheral portion) of the substrate during polishing of the substrate. Such non-uniform pressing force would result in so-called "rounded edge" which is excessive polishing that occurs only in the edge portion of the substrate. In order to prevent such rounded edge, a retaining ring for retaining the edge portion of the substrate is provided so as to be vertically movable relative to a top ring body (or carrier head body) and to press the polishing surface of the polishing pad located at the outer circumferential edge side of the substrate.

In the above-described polishing apparatus, because a frictional force is generated between the substrate and the polishing pad during polishing, this frictional force is received by the retaining ring to prevent the substrate from being slipped out of the lower part of the top ring body. Further, as described above, the retaining ring presses the polishing pad to deform the polishing pad, so that the polishing amount of the edge portion (peripheral portion) of the substrate is controlled by the deformation of the polishing pad.

When the substrate is polished under high frictional forces developed between the substrate and the polishing pad and at a low relative speed between the substrate and the polishing pad, the substrate holding apparatus tends to vibrate due to stick-slip, etc. The substrate which is being polished may be slipped out of the top ring by vibrations caused under such strict polishing conditions. Since the polishing of the substrate in such a vibrational range should be avoided, the actual range of polishing conditions is narrower than those that can be established by the polishing recipe. Attempts to reduce the unpolishable range increase the degree of freedom for combination of recipes, leading to improved polishing performance.

According to a study conducted by the inventors of the present invention, the source of the vibrations is considered to lie between the polishing pad and the substrate, and it is considered that the vibrations of the substrate are transmitted through the retaining ring to the top ring body and the pressing by the retaining ring becomes unstable due to complex factors such as resonance of the top ring, and thus a gap is formed between the retaining ring and the polishing pad to cause the substrate to be slipped out of the top ring during polishing.

SUMMARY OF THE INVENTION

According to embodiments, there are provided a substrate holding apparatus and a polishing apparatus which can reduce vibrations of a top ring in its entirety by damping vibrations transmitted from a retaining ring to a top ring body.

Embodiments, which will be described below, relate to a substrate holding apparatus for use in a polishing apparatus for polishing a substrate such as a wafer, and more particularly to a substrate holding apparatus for holding a substrate and pressing the substrate against a polishing surface. The embodiments further relate to a polishing apparatus having such a substrate holding apparatus.

In order to achieve the above object, in an embodiment, there is provided a substrate holding apparatus comprising: a top ring body having a substrate holding surface configured to hold and press a substrate against a polishing surface; a retaining ring configured to surround the substrate and to contact the polishing surface; and a drive ring comprising a ring member configured to hold the retaining ring on a lower surface thereof, a central member disposed at a central part of the top ring body and supported by the top ring body, and a connecting portion configured to connect the ring member and the central member; wherein the drive ring comprises a first material and a second material having a modulus of longitudinal elasticity smaller than the first material.

According to the embodiment, since the drive ring comprises a first material and a second material having a modulus of longitudinal elasticity smaller than the first material, vibrations generated in the retaining ring during polishing are damped by the second material when the vibrations are transmitted from the first material to the second material of the drive ring. Therefore, the vibrations that are transmitted from the retaining ring through the drive ring to the top ring body can be damped, and hence vibrations of the top ring in its entirety can be damped. Accordingly, vibrations of the top ring in its entirety can be reduced.

In an embodiment, the second material comprises a rubber material.

According to the embodiment, by using the rubber material as the second material, a large vibration damping effect can be obtained.

In an embodiment, the connecting portion comprises a plurality of connecting arms.

In an embodiment, there is provided a substrate holding apparatus comprising: a top ring body having a substrate holding surface configured to hold and press a substrate against a polishing surface; a retaining ring configured to surround the substrate and to contact the polishing surface; and a drive ring comprising a ring member configured to hold the retaining ring on a lower surface thereof, a central member disposed at a central part of the top ring body and supported by the top ring body, and a plurality of connecting arms configured to connect the ring member and the central member; wherein the drive ring comprises a central section including the central member and the plurality of connecting arms, and a ring section comprising the ring member, the central section and the ring section being connected to each other by fasteners; or the drive ring comprises a central section including the central member and radially inner portions of the connecting arms, and a ring section including radially outer portions of the connecting arms and the ring member, the central section and the ring section being connected to each other by fasteners.

According to the embodiment, since the drive ring comprises a split structure composed of the central section and the ring section, a member having a smaller modulus of longitudinal elasticity than the central section and the ring section can be interposed at the connecting portion of the central section and the ring section. Therefore, when vibrations generated in the retaining ring during polishing are transmitted from the ring section to the central section of the drive ring, the vibrations can be damped by the member, having the smaller modulus of longitudinal elasticity, provided at the connecting portion. Accordingly, vibrations of the top ring in its entirety can be reduced.

In an embodiment, the central section comprises a first material; and a portion comprising a second material having a modulus of longitudinal elasticity smaller than the first material is provided at the connecting portion of the central section and the ring section.

In an embodiment, a rubber material is provided at the connecting portion of the central section and the ring section.

According to the embodiment, a large vibration damping effect can be obtained by the rubber material provided at the connecting portion of the central section and the ring section of the drive ring.

In an embodiment, there is provided a substrate holding apparatus comprising: a top ring body configured to hold and press a substrate against a polishing surface; a retaining ring configured to surround the substrate and to contact the polishing surface; and a drive ring comprising a ring member configured to hold the retaining ring on a lower surface thereof, a central member disposed at a central part of the top ring body and supported by the top ring body, and a plurality of connecting arms configured to connect the ring member and the central member; wherein the central member comprises a first material; and a portion comprising a second material having a modulus of longitudinal elasticity smaller than the first material is provided between the central member of the drive ring and a guide shaft fixed to the central member of the drive ring and inserted in a bearing provided in the top ring body.

According to the embodiment, since the rubber material is provided at the connecting portion of the drive ring and the guide shaft, when vibrations from the retaining ring are transmitted through the drive ring to the guide shaft, the vibrations are damped by the rubber material. Consequently, vibrations of the top ring in its entirety are reduced.

In an embodiment, the second material comprises a rubber material.

In an embodiment, the rubber material comprises one of EPDM, fluororubber, nitrile rubber, urethane rubber, silicone rubber, and synthetic rubber with an increased damping capability.

In an embodiment, the rubber material comprises a molded rubber material.

According to the embodiment, the rubber material can be provided between the components in the connecting portion by a mold type in which a clearance is provided between the components and rubber is poured into the clearance.

In an embodiment, the connecting portion of the connecting arm has a shape configured to compress the rubber material provided between surfaces of the connecting portion so as to receive tensile, compressive, shearing, and bending loads applied thereto.

In an embodiment, the drive ring is supported so that the drive ring is capable of tilting and vertically moving, by a guide shaft connected to the central member of the drive ring, and a spherical bearing disposed at the central part of the top ring body; and each of the connecting arms is sandwiched between a pair of rollers supported on a carrier holding a membrane so that movement of the drive ring in a rotational direction is restricted.

According to the embodiment, the spherical bearing and the fitting of the guide shaft allow the drive ring and the retaining ring to move vertically and tilt, while restricting the lateral movement (i.e., the horizontal movement) of the drive ring and the retaining ring. During polishing of the substrate, the retaining ring receives a lateral force (i.e., a force in a radially outward direction of the substrate) caused by a friction between the substrate and the polishing pad. This lateral force is transmitted to the spherical bearing through the drive ring and received by the spherical bearing. In this manner, while the spherical bearing receives the lateral force (i.e., the force in the radially outward direction of the substrate) applied to the retaining ring from the substrate due to the friction between the substrate and the polishing pad, the spherical bearing restricts the lateral movement of the retaining ring (i.e., fixes the horizontal position of the retaining ring). Further, according to the embodiment, each of the connecting arms is sandwiched between a pair of rollers fixed to the carrier, so that the degree of freedom in the rotational direction of the drive ring is restricted.

In an embodiment, there is provided a polishing apparatus comprising: a substrate holding apparatus according to the above embodiments; and a polishing table configured to support a polishing pad having a polishing surface.

According to the embodiment, vibrations transmitted from the retaining ring through the drive ring to the top ring body are damped to reduce vibrations of the top ring in its entirety.

Further, according to the embodiment, because vibrations generated under polishing conditions that combine high frictional forces between the substrate and the polishing pad and a low relative speed between the substrate and the polishing pad can be suppressed, the substrate can be prevented from being damaged, and thus the range of combinations of polishing conditions (process window) can be broadened.

BRIEF DESCRIPTION OF THE DRAWINGS

FIG. 7A shows the central section and the ring section before they are connected to each other, FIG. 7B shows the central section and the ring section after they are connected to each other, and FIG. 7C is a plan view showing the central section and the ring section after they are connected to each other;

FIG. 10 is an exploded perspective view showing the drive ring.

DESCRIPTION OF EMBODIMENTS

Figure 1:
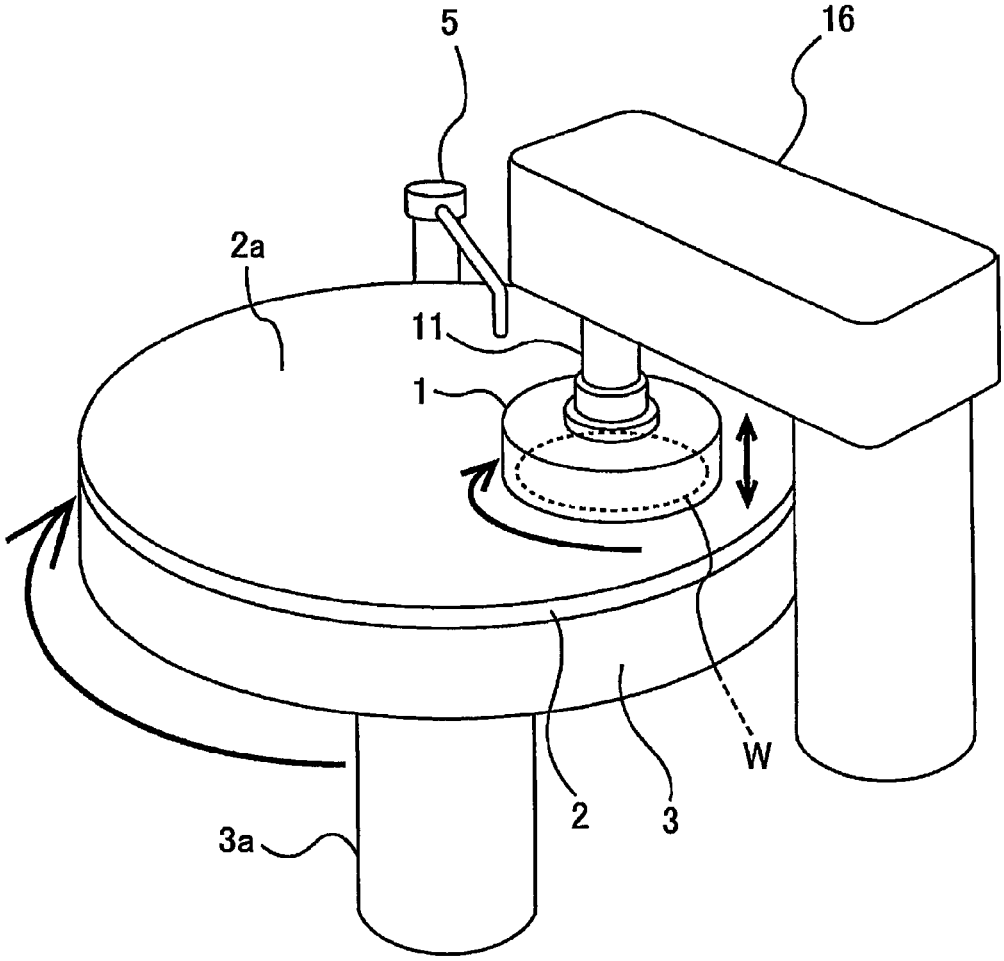
FIG. 1 is a schematic view of an overall arrangement of a polishing apparatus having a substrate holding apparatus according to an embodiment.

A substrate holding apparatus and a polishing apparatus according to embodiments will be described in detail below with reference to FIGS. 1 to 11. In FIGS. 1 to 11, identical or corresponding parts are denoted by identical reference numerals throughout the views and their repetitive explanations will be omitted.

FIG. 1 is a schematic view showing an overall arrangement of a polishing apparatus having a substrate holding apparatus according to an embodiment. As shown in FIG. 1, the polishing apparatus has a polishing table 3 supporting a polishing pad 2 thereon, and a top ring 1 as a substrate holding apparatus for holding a substrate W such as a wafer as an object to be polished and pressing the substrate W against the polishing pad 2.

The polishing table 3 is coupled through a table shaft 3*a* to a motor (not shown) disposed below the polishing table 3, and is rotatable about the table shaft 3*a* by the motor. The polishing pad 2 is attached to an upper surface of the polishing table 3, and the upper surface 2*a* of the polishing pad 2 constitutes a polishing surface for polishing the substrate W. A polishing liquid supply mechanism 5 is provided above the polishing table 3 to supply a polishing liquid onto the polishing pad 2.

The top ring 1 is coupled to a top ring shaft 11 that is vertically moved by a vertically moving mechanism (not shown) disposed in a top ring head 16. When the top ring shaft 11 is moved up and down, the top ring 1 in its entirety is elevated and lowered relative to the top ring head 16 as indicated by an arrow, so that positioning of the top ring 1 is performed. The top ring shaft 11 is further coupled to a rotating mechanism (not shown) housed in the top ring head 16, so that the top ring shaft 11 is rotated about its own axis. Thus, when the top ring shaft 11 is rotated, the top ring 1 is rotated about its own axis, as indicated by an arrow.

Figure 2:
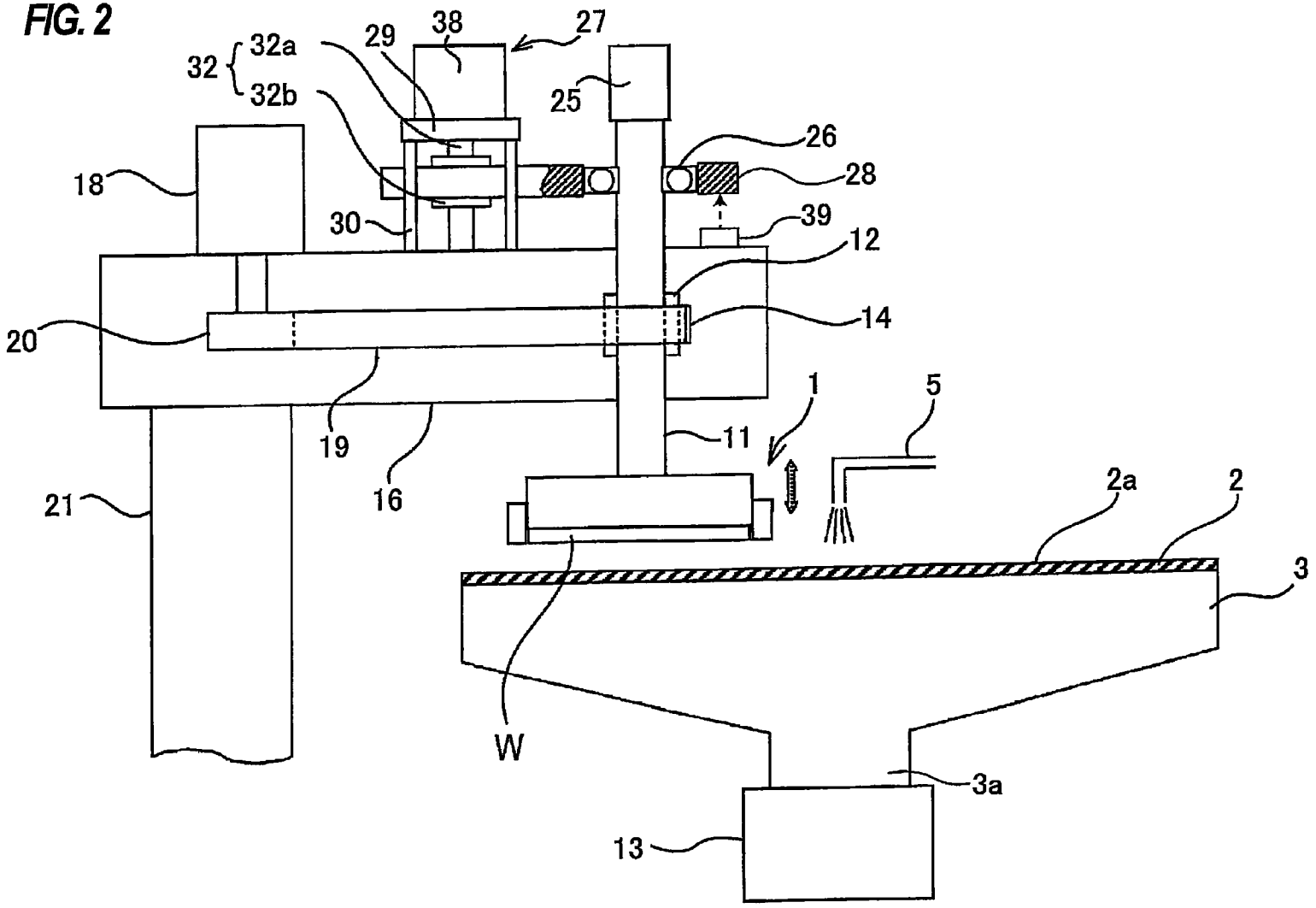
FIG. 2 is a view showing a detailed structure of the polishing apparatus.

FIG. 2 is a view showing a detailed structure of the polishing apparatus. The polishing table 3 is coupled through the table shaft 3*a* to a motor 13 disposed below the polishing table 3, and is rotatable about the table shaft 3*a* by the motor 13. The polishing pad 2 is attached to the upper surface of the polishing table 3, and the upper surface of the polishing pad 2 constitutes the polishing surface 2*a* for polishing the substrate W. When the polishing table 3 is rotated by the motor 13, the polishing surface 2*a* moves relative to the top ring 1.

The top ring 1 is coupled to the top ring shaft 11, which is vertically movable relative to the top ring head 16 by a vertically moving mechanism 27. By the vertical movement of the top ring shaft 11, the top ring 1 in its entirety is elevated and lowered for positioning with respect to the top ring head 16. A rotary joint 25 is attached to an upper end of the top ring shaft 11.

The vertically moving mechanism 27 for elevating and lowering the top ring shaft 11 and the top ring 1 includes a bridge 28 for rotatably supporting the top ring shaft 11 through a bearing 26, a ball screw 32 mounted on the bridge 28, a support base 29 supported by pillars 30, and a servomotor 38 provided on the support base 29. The support base 29 for supporting the servomotor 38 is secured to the top ring head 16 through the pillars 30.

The ball screw 32 has a screw shaft 32*a* coupled to the servomotor 38 and a nut 32*b* which is in engagement with the screw shaft 32*a*. The top ring shaft 11 is configured to move vertically together with the bridge 28. Therefore, when the servomotor 38 is set in motion, the bridge 28 moves vertically through the ball screw 32 to cause the top ring shaft 11 and the top ring 1 to move vertically. A top ring height sensor 39 is mounted on the top ring head 16 so as to face the bridge 28. This top ring height sensor 39 is configured to measure a height of the top ring 1 based on a position of the bridge 28 which is vertically movable in unison with the top ring 1.

Further, the top ring shaft 11 is coupled to a rotary cylinder 12 through a key (not shown). This rotary cylinder 12 has a timing pulley 14 on its outer circumferential portion. A top ring motor 18 is secured to the top ring head 16, and a timing pulley 20 is mounted to the top ring motor 18. The timing pulley 14 is coupled to the timing pulley 20 through a timing belt 19. Therefore, rotation of the top ring motor 18 is transmitted to the rotary cylinder 12 and the top ring shaft 11 through the timing pulley 20, the timing belt 19, and the timing pulley 14 to rotate the rotary cylinder 12 and the top ring shaft 11 in unison, thus rotating the top ring 1 about its own axis. The top ring head 16 is supported by a top ring head shaft 21 which is rotatably supported by a frame (not shown).

The top ring 1 is configured to hold the substrate W on its lower surface. The top ring head 16 is configured to be pivotable about the top ring shaft 21, so that the top ring 1, holding the substrate W on its lower surface, is moved from a transfer position of the substrate W to a position above the polishing table 3 by the pivotal movement of the top ring head 16. The top ring 1 is then lowered to press the substrate W against the polishing surface 2*a* of the polishing pad 2. At this time, the top ring 1 and the polishing table 3 are rotated respectively and the polishing liquid is supplied onto the polishing pad 2 from the polishing liquid supply mechanism 5 disposed above the polishing table 3. In this manner, the substrate W is brought in sliding contact with the polishing surface 2*a* of the polishing pad 2 in the presence of the polishing liquid between the polishing pad 2 and the substrate W, whereby the surface of the substrate W is polished.

Figure 3:
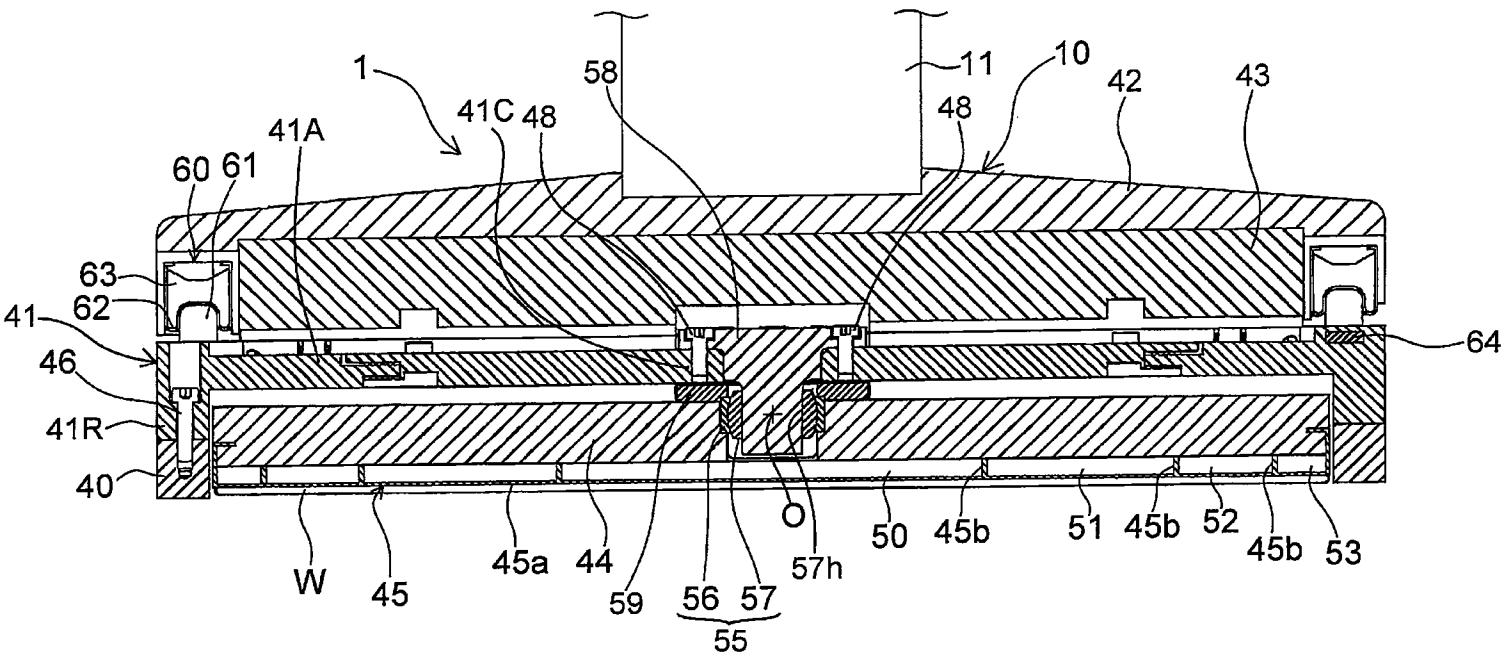
FIG. 3 is a cross-sectional view of the top ring.

The top ring 1, which serves as the substrate holding apparatus, will be described in detail below. FIG. 3 is a cross-sectional view of the top ring 1. As shown in FIG. 3, the top ring 1 includes a top ring body 10 for pressing the substrate W against the polishing surface 2*a*, and a retaining ring 40 arranged so as to surround the substrate W. The top ring body 10 and the retaining ring 40 are rotatable in unison by the rotation of the top ring shaft 11. The retaining ring 40 is configured to be vertically movable independently of the top ring body 10.

The top ring body 10 has a circular flange 42, a spacer 43 mounted to a lower surface of the flange 42, and a carrier 44 mounted to a lower surface of the spacer 43. The flange 42 is coupled to the top ring shaft 11. The carrier 44 is coupled to the flange 42 through the spacer 43, so that the flange 42, the spacer 43 and the carrier 44 rotate and vertically move in unison. The top ring body 10, which is constructed by the flange 42, the spacer 43 and the carrier 44, is made of resin such as engineering plastics (e.g., PEEK). The flange 42 may be made of metal, such as SUS, aluminum, or the like.

A membrane (elastic membrane) 45, which is brought into contact with a back surface of the substrate W, is attached to a lower surface of the carrier 44. The membrane 45 has a lower surface which serves as a substrate holding surface 45*a*. The membrane 45 has a plurality of concentric partition walls 45*b* which define four pressure chambers: a central chamber 50; a ripple chamber 51; an outer chamber 52; and an edge chamber 53, which are located between the membrane 45 and the carrier 44. These pressure chambers 50, 51, 52 and 53 are in fluid communication with a pressure regulator (not shown) via the rotary joint 25 (see FIG. 2), so that a pressurized fluid is supplied into these pressure chambers 50, 51, 52 and to 53 from the pressure regulator. This pressure regulator is configured to be able to regulate pressures in the respective four pressure chambers 50, 51, 52 and 53 independently. Further, the pressure regulator is configured to be able to produce negative pressure in the pressure chambers 50, 51, 52 and 53. The membrane 45 has a through-hole (not shown) in a position corresponding to the ripple chamber 51 or the outer chamber 52, so that the top ring 1 can hold the substrate on its substrate holding surface 45*a* by producing the negative pressure in the through-hole. The membrane 45 is made of a highly strong and durable rubber material, such as ethylene propylene rubber (EPDM), polyurethane rubber, silicone rubber, or the like. The central chamber 50, the ripple chamber 51, the outer chamber 52, and the edge chamber 53 are further coupled to a pressure relief mechanism (not shown), which can establish a fluid communication between the atmosphere and these four pressure chambers 50, 51, 52 and 53.

The retaining ring 40 is disposed so as to surround the carrier 44 and the membrane 45 of the top ring body 10. This retaining ring 40 is coupled to a drive ring 41 by a plurality of bolts 46 which are disposed at intervals in a circumferential direction of the retaining ring 40. The drive ring 41 comprises a ring member 41R for holding the retaining ring 40 on its lower surface, a central member 41C disposed at a central part of the top ring body 10 and supported by the top ring body 10, and a plurality of connecting arms 41A for connecting the ring member 41R and the central member 41C (described later). The retaining ring 40 is arranged so as to surround a peripheral edge of the substrate W and retains the substrate W therein so as to prevent the substrate W from being slipped out of the top ring 1 during polishing of the substrate W.

A spherical bearing 55 is disposed at a central part of the carrier 44. The spherical bearing 55 comprises an outer ring 56 fixed to the carrier 44, and an inner ring 57 supported by the outer ring 56, and is fixed to the central part of the carrier 44 by a flange 59. The inner circumferential surface of the outer ring 56 and the outer circumferential surface of the inner ring 57 are formed into spherical surfaces whose center is a fulcrum O so that the spherical surfaces are brought in sliding contact with each other, and the inner ring 57 is rotatable (tiltable) in all directions (360°) about the fulcrum O with respect to the outer ring 56.

On the other hand, a guide shaft 58 is fixed to the central member 41C located at the central part of the drive ring 41 by a plurality of bolts 48. The shaft portion of the guide shaft 58 is fitted in a through-hole 57*h* of the inner ring 57, and thus the guide shaft 58 is vertically movable relative to the inner ring 57 of the spherical bearing 55. Therefore, the drive ring 41 coupled to the guide shaft 58 is positionally fixed to the carrier 44 through a linear motion guide of the spherical bearing 55. The guide shaft 58 is made of metal such as stainless steel (for example, SUS304) or ceramics. Ceramics are required in the case where the sensor for measuring a film thickness of the substrate is an eddy current type sensor.

As a material of the spherical bearing 55, resin having a low frictional resistance and a high wear resistance such as engineering plastics or ceramics are used. However, a metal material such as stainless steel may be used.

The spherical bearing 55 and the fitting of the guide shaft 58 allow the drive ring 41 and the retaining ring 40 to move vertically and tilt, while restricting the lateral movement (i.e., the horizontal movement) of the drive ring 41 and the retaining ring 40. During polishing of the substrate, the retaining ring 40 receives a lateral force (i.e., a force in a radially outward direction of the substrate) caused by a friction between the substrate and the polishing pad 2. This lateral force is transmitted to the spherical bearing 55 through the drive ring 41 and received by the spherical bearing 55. Therefore, the spherical bearing 55 serves as a supporting mechanism capable of receiving the lateral force (i.e., the force in the radially outward direction of the substrate) applied to the retaining ring 40 from the substrate due to the friction between the substrate and the polishing pad 2 and capable of restricting the lateral movement of the retaining ring 40 (i.e., capable of fixing the horizontal position of the retaining ring 40).

As shown in FIG. 3, the upper part of the drive ring 41 is coupled to an annular retaining ring pressing mechanism 60, which is configured to exert a uniform downward load on an entire upper surface of the drive ring 41 to thereby press a lower surface of the retaining ring 40 against the polishing surface 2*a* of the polishing pad 2.

The retaining ring pressing mechanism 60 includes a piston 61 located immediately above the drive ring 41, and an annular rolling diaphragm 62 connected to an upper surface of the piston 61. The rolling diaphragm 62 defines a retaining ring pressure chamber 63 therein. This retaining ring pressure chamber 63 is connected to the pressure regulator through the rotary joint 25 (see FIG. 2). When the pressure regulator supplies a pressurized fluid (e.g., pressurized air) into the retaining ring pressure chamber 63, the rolling diaphragm 62 pushes down the piston 61, which in turn pushes down the drive ring 41 in its entirety. In this manner, the retaining ring pressing mechanism 60 presses the lower surface of the retaining ring 40 against the polishing surface 2*a* of the polishing pad 2. Further, when the pressure regulator develops the negative pressure in the retaining ring pressure chamber 63, the retaining ring 40 and the drive ring 41 in their entirety can be elevated. The retaining ring pressure chamber 63 is coupled to a pressure relief mechanism (not shown), which can establish a fluid communication between the atmosphere and the retaining ring pressure chamber 63.

The drive ring 41 is removably coupled to the retaining ring pressing mechanism 60. More specifically, the piston 61 is made of a magnetic material such as metal, and a plurality of magnets 64 are disposed at the upper portion of the drive ring 41 at intervals in a circumferential direction of the drive ring 41 (only one magnet 64 is shown in FIG. 3). These magnets 64 magnetically attract the piston 61, so that the drive ring 41 is secured to the piston 61 by a magnetic force. The magnetic material of the piston 61 may be corrosion resistant magnetic stainless steel. The drive ring 41 may be made of a magnetic material, and magnets may be disposed on the piston 61.

As shown in FIG. 3, the top ring shaft 11 is connected to the flange 42 to hold the top ring in its entirety. The pipes of the membrane pressure and the retaining pressure pass through the top ring shaft. The top ring shaft 11 is connected to the ball screw 32 and the motor 38 (see FIG. 2), so that the height of the top ring 1 at the time of polishing is controlled. In the top ring 1 for polishing the substrate using the membrane 45, the polishing characteristics are changed depending on the degree of deformation of the membrane 45. Since the membrane 45 shows non-linear stretch in a vertical direction, when the height of the top ring 1 is changed, the distribution of surface pressure to the substrate by the membrane 45 is changed. Therefore, in order to obtain stable polishing characteristics, it is necessary to maintain the equal distance between the carrier 44 for holding the membrane 45 and the polishing pad 2 and to equalize the deformation shape. According to the embodiment, the height of the top ring 1 at the time of polishing is controlled so that the relative positional relationship between the membrane 45, the substrate W and the polishing pad 2 becomes an optimum position in view of the polishing process.

The retaining ring 40 is worn away by the friction with the polishing pad 2 during polishing. Even if the retaining ring 40 is worn away, in order to maintain the pressing force of the retaining ring 40 against the polishing pad 2, the retaining ring 40 is freely movable in the vertical direction relative to the carrier 44 holding the membrane. Even if the height of the top ring 1 is changed, the retaining ring 40 is pressed by the air bag (rolling diaphragm 62) so that the retaining ring 40 can be brought into contact with the polishing pad 2. In particular, as shown in FIG. 3, the air bag (rolling diaphragm 62) has a configuration in which folding-back portions are provided at an inner diameter side and an outer diameter side of the piston 61, and thus the folding-back portions move like rolling over when the piston 61 is vertically moved. Thus, even if the piston 61 vertically moves, an elongation of the rubber is not changed, and thus the loss of thrust force can be minimized.

Figure 4:
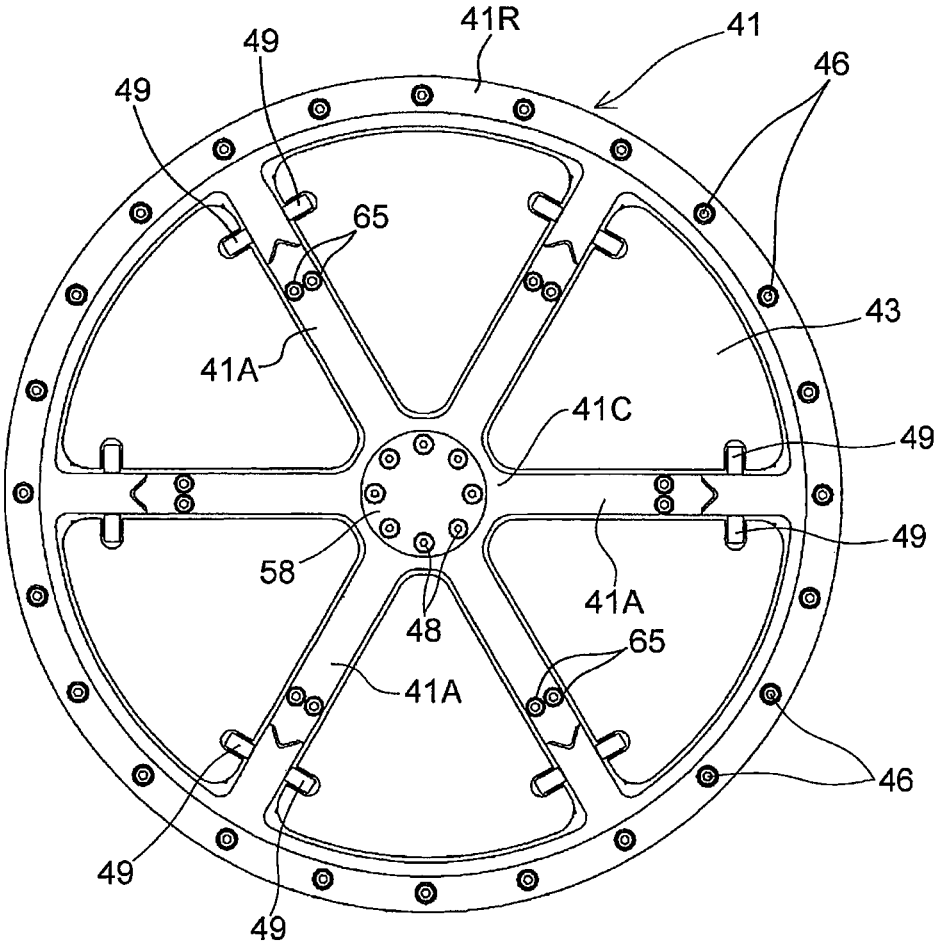
FIG. 4 is a plan view showing the drive ring.

FIG. 4 is a plan view showing the drive ring 41. As shown in FIG. 4, the drive ring 41 includes a ring member 41R for holding the retaining ring 40 on its lower surface, a hub-shaped central member 41C disposed centrally in the drive ring 41, and a plurality of connecting arms 41A extending radially to interconnect the central member 41C and the ring member 41R. In FIG. 4, a number of bolts 46, which are disposed at intervals in a circumferential direction of the ring member 41R, to fasten the retaining ring 40 to the lower surface of the ring member 41R are shown. The guide shaft 58 is fastened to the central member 41C located centrally in the drive ring 41 by a plurality of bolts 48. Each of the plural connecting arms 41A extending radially to interconnect the central member 41C and the ring member 41R is divided into a radially inner portion and a radially outer portion that are fastened to each other by bolts 65 (described later). Each of the connecting arms 41A is sandwiched between a pair of rollers 49, 49 fixed to the carrier 44, so that the degree of freedom in the rotational direction of the drive ring 41 is restricted.

Before and after the polishing process, the substrate to be processed is transferred. Since the retaining ring 40 positioned at an outer circumferential side of the substrate becomes an obstacle to the transfer action of the substrate, a mechanism for pushing up the retaining ring 40 from outside is required. The pushing-up mechanism is referred to as a pusher or a retaining ring station. When the pushing-up mechanism is lowered, it is necessary for the retaining ring 40 to drop by its own weight and to return to its original position. Clearances are required between the rollers 49 and the drive ring 41 so that an up-and-down motion of the drive ring 41 that holds the retaining ring 40 is not interrupted at the time of pushing-up action and drop action. According to the present embodiment, the clearance between the roller 49 and the connecting arm 41A of the drive ring 41 is set to about 0.2 to 0.5 mm, the tilting motion and the vertical movement of the drive ring 41 are not restricted more than necessary.

Each of the rollers 49 may comprises an integral member made of resin. However, each of the rollers 49 should preferably be composed of an inner ring and an outer ring with a rubber molded therebetween for absorbing vibrations and positional deviation of the roller 49 and the drive ring 41 due to manufacturing errors.

Figure 5:
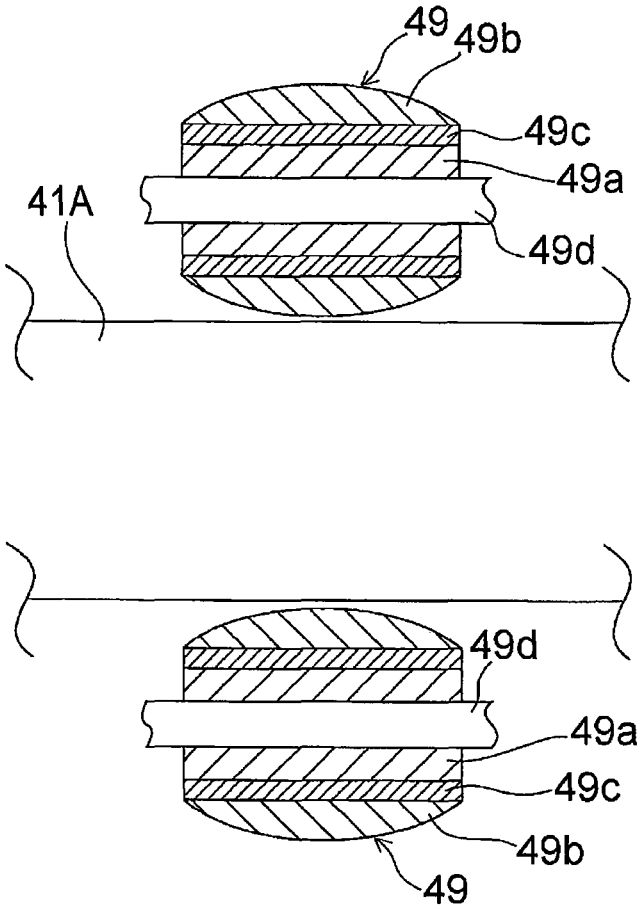
FIG. 5 is a cross-sectional view showing rollers each composed of an inner ring and an outer ring with a rubber molded therebetween.

FIG. 5 is a cross-sectional view showing two rollers each composed of an inner ring and an outer ring with a rubber molded therebetween. As shown in FIG. 5, the connecting arm 41A is sandwiched between the pair of rollers 49, 49. As described above, clearance of about 0.2 to 0.5 mm is set between each of the rollers 49 and the connecting arm 41A. Each of the rollers 49 is composed of an inner ring 49*a* and an outer ring 49*b* with a rubber 49*c* molded therebetween. A shaft 49*d* is provided at an inner side of the inner ring 49*a*, and both ends of the shaft 49*d* are supported by the carrier 44 (not shown). As shown in FIG. 5, the rubber 49*c* is molded between the inner ring 49*a* and the outer ring 49*b*, and thus vibrations can be absorbed and positional deviation between the roller 49 and the drive ring 41 due to manufacturing errors can be absorbed.

Figure 6:
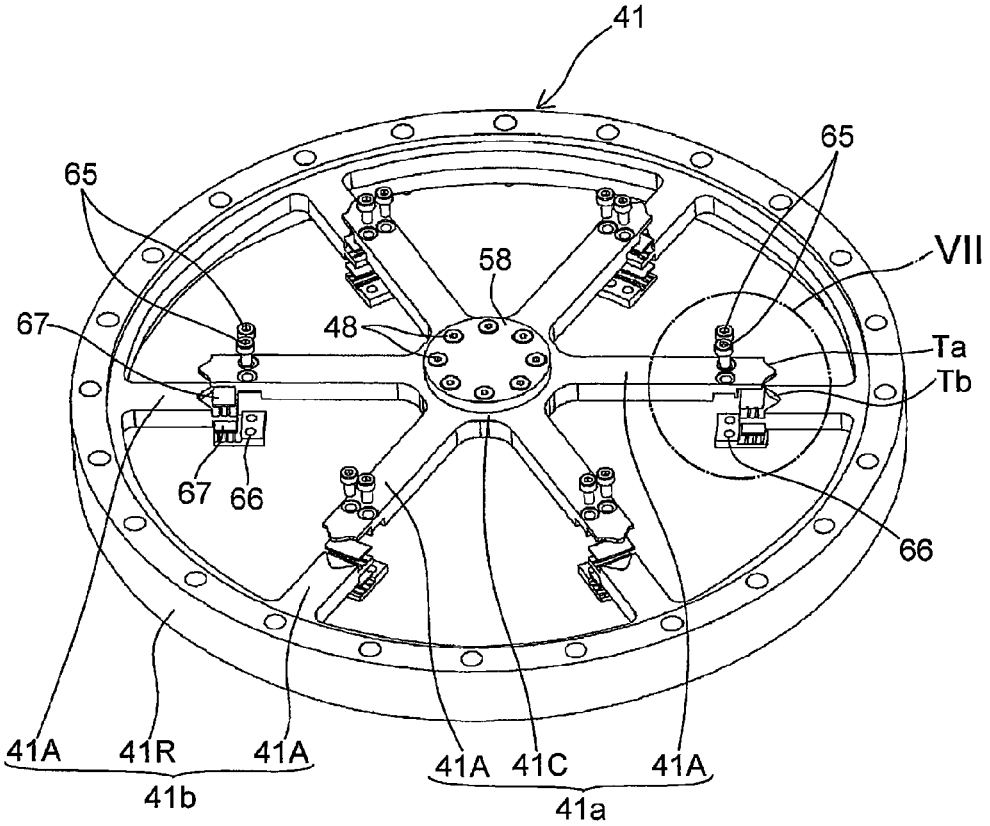
FIG. 6 is a view showing a drive ring according to a first embodiment, and an exploded perspective view of the drive ring.
Figure 7A:
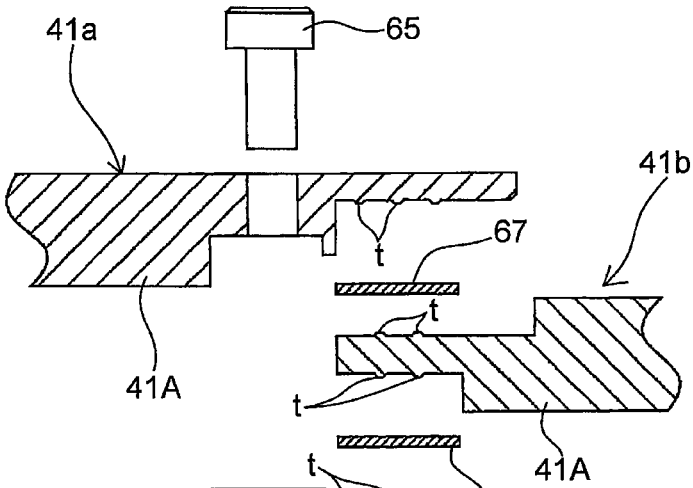
FIGS. 7A, 7B, and 7C are enlarged views showing a portion VII in FIG. 6.
Figure 7B:
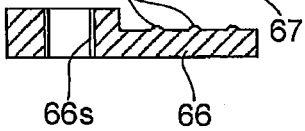
Figure 7B:
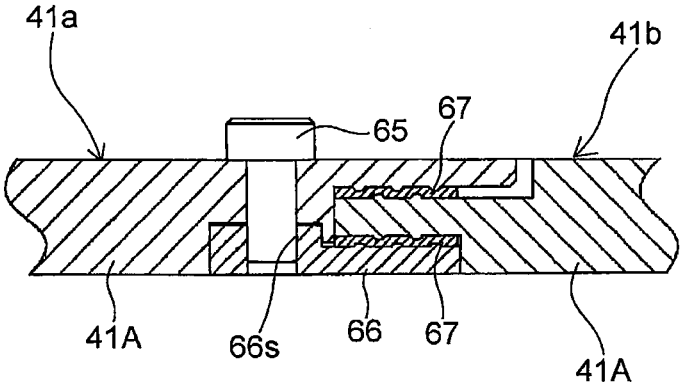
Figure 7C:
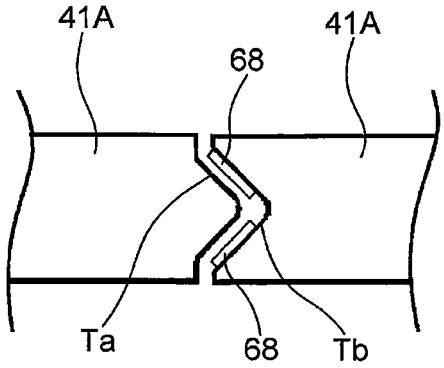

FIGS. 6, 7A, 7B and 7C are views showing a drive ring 41 according to a first embodiment. Specifically, FIG. 6 is an exploded perspective view of the drive ring 41, and FIGS. 7A, 7B and 7C are enlarged views showing a portion VII in FIG. 6. As shown in FIG. 6, the drive ring 41 comprises a two-split structure which is divided into a central side and an outer circumferential side in the middle of the plural connecting arms 41A extending radially. Specifically, the drive ring 41 is divided into a central section 41*a* comprising a central member 41C and major portions of the plural connecting arms 41A which extend radially outwardly from the central member 41C, and a ring section 41*b* comprising a ring member 41R and the remaining portions of the plural connecting arms 41A which extend radially inwardly from the ring member 41R. A guide shaft 58 is fastened by bolts 48 to the central member 41C of the central section 41*a*. The central section 41*a* and the ring section 41*b* are fastened to each other by bolts 65 and clamps 66 at respective ends of the major and remaining portions of the connecting arms 41A.

FIG. 7A shows the central section 41*a* and the ring section 41*b* before they are connected to each other, and FIG. 7B shows the central section 41*a* and the ring section 41*b* after they are connected to each other.

As shown in FIG. 7A, a rubber sheet 67 is provided between the end of the portion of the connecting arm 41A of the central section 41*a* and the end of the portion of the connecting arm 41A of the ring section 41*b*, and another rubber sheet 67 is provided between the end of the portion of the connecting arm 41A of the ring section 41*b* and the clamp 66. The clamp 66 has screw holes 66*s* defined therein. The end of the portion of the connecting arm 41A of the ring section 41*b* has projecting portions t, t on its upper and lower surfaces. Further, the end of the portion of the connecting arm 41A of the central section 41*a* has projecting portions t on its lower surface, and the clamp 66 has projecting portions t on its upper surface.

As shown in FIG. 7B, by screwing the bolts 65 into the respective screw holes 66*s* of the clamp 66, the end of the portion of the connecting arm 41A of the ring section 41*b* is fixedly sandwiched between the end of the portion of the connecting arm 41A of the central section 41*a* and the clamp 66 with the two rubber sheets 67 interposed therebetween. Therefore, the rubber sheets 67 are interposed between the central section 41*a* and the ring section 41*b*, and thus vibrations generated in the retaining ring 40 are damped by the rubber sheets 67 and then transmitted to the central section 41*a*. Consequently, vibrations of the top ring in its entirety are reduced. As shown in FIGS. 7A and 7B, in order to enhance fixing forces of the connecting part (fastening part), it is desirable that the concavo-convex portions are provided at the portions for sandwiching the rubber sheets 67 to allow the respective components to bite into the rubber sheets. Further, as in this example, the central section 41*a* and the ring section 41*b* have respective configurations whose surfaces contact and compress the rubber sheets therebetween, so that tensile, compressive, shearing, and bending forces applied thereto can be received.

Clearances between the respective components in the connecting portions are determined in view of the degree of freedom to be given thereto. Since the central section 41*a* and the ring section 41*b* are movable relative to each other by a distance corresponding to the degree of freedom, the damping effect of vibrations by the rubber can be achieved. If this degree of freedom is increased excessively, when frictional forces greater than the fixing forces produced by sandwiching the rubber are applied, the central section 41*a* and the ring section 41*b* are liable to be displaced from each other.

In the example shown in FIGS. 6, 7A, 7B and 7C, the degree of freedom in the lateral direction between the ends of the portions of the connecting arms 41A is established by clearances between fitting portions of the respective components. The degree of freedom in the rotational direction between the ends of the portions of the connecting arms 41A is established by dogleg-shaped concavo-convex portions provided at the ends of the portions of the connecting arms 41A as shown in FIG. 7C. Specifically, the end of the connecting arm 41A of the central section 41*a* has a dogleg-shaped convex portion Ta, whereas the end of the connecting arm 41A of the ring section 41*b* has a dogleg-shaped concave portion Tb, and the degree of freedom is established by intermeshing engagement between the convex and concave portions Ta, Tb.

As shown in FIG. 7C, rubbers 68, 68 may be disposed between the facing surfaces of the dogleg-shaped convex and concave portions Ta, Tb of the ends of the portions of the connecting arms 41A to prevent the convex and concave portions Ta, Tb from being brought into direct contact with each other.

In the example shown in FIGS. 6, 7A, 7B and 7C, an assembling type in which the rubber sheets are sandwiched is used. However, a mold type in which a clearance is provided between the components and rubber is poured into the clearance may be used.

The positional relationship between a pair of rollers 49, 49 and the connecting arm 41A of the drive ring 41 will be described below. The positional relationship between the pair of rollers 49, 49 and the drive ring 41 comprising the central section 41*a* and the ring section 41*b* which are a two-split structure as shown in FIGS. 6, 7A, 7B and 7C should preferably be such that loads and vibrations from the retaining ring 40 can be received before they are transmitted to the central section 41*a*. Therefore, as shown in FIG. 4, the pair of rollers 49, 49 should preferably be disposed in such a position as to sandwich the portion of the connecting arm 41A extending from the ring section 41*b*, thereby enabling the portion of the connecting arm 41A at the side of the ring section 41*b* to receive loads and vibrations from the retaining ring 40 so that they are not transmitted to the central section 41*a*.

Figure 8:
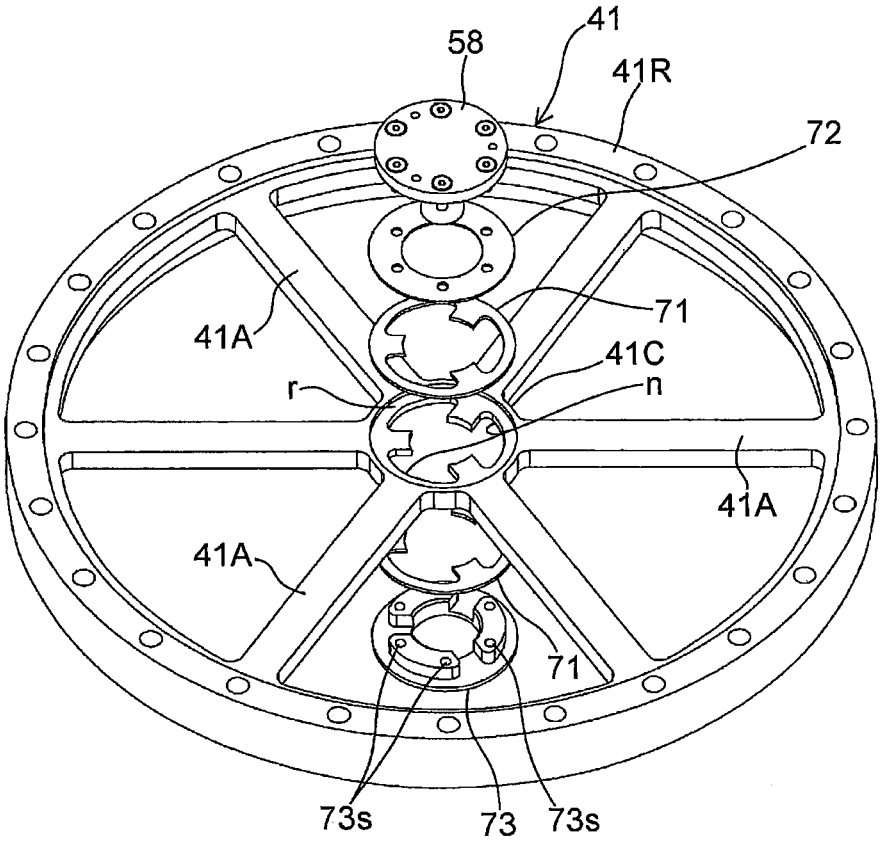
FIG. 8 is a view showing a drive ring according to a second embodiment, and an exploded perspective view showing the drive ring and a guide shaft.
Figure 9:
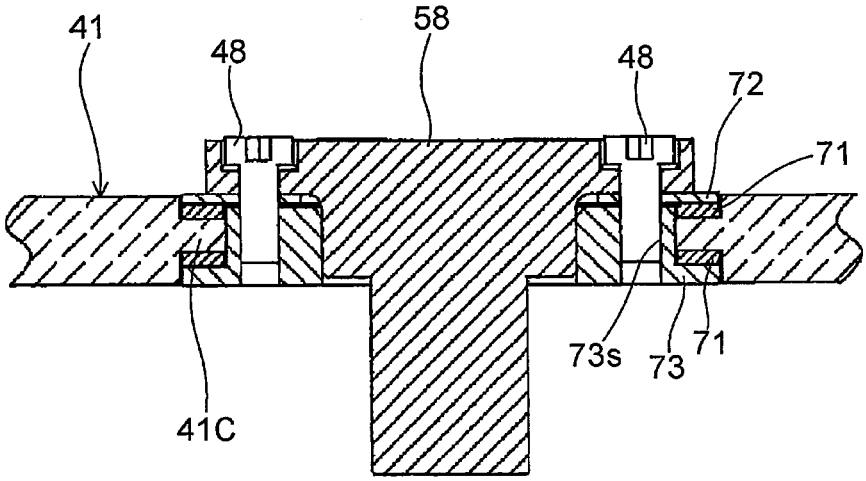
FIG. 9 is a view showing the drive ring according to the second embodiment, and a fragmentary cross-sectional view showing the state in which the drive ring and the guide ring are connected to each other.

FIGS. 8 and 9 are views showing a drive ring 41 according to a second embodiment, and FIG. 8 is an exploded perspective view showing the drive ring 41 and a guide shaft 58 and FIG. 9 is a fragmentary cross-sectional view showing the state in which the drive ring 41 and the guide ring 58 are connected to each other. According to the second embodiment, rubber sheets are provided at the connecting portion of the drive ring 41 and the guide shaft 58.

As shown in FIG. 8, in the second embodiment, the drive ring 41 comprises a ring member 41R, a central member 41C, and a plurality of connecting arms 41A that are not a split structure but an integral structure. A pair of rubber sheets 71, 71 for damping vibrations, and an upper flange 72 and a lower flange 73 are disposed at a portion of the central member 41C of the drive ring 41 to which the guide shaft 58 is fixed. The central member 41C of the drive ring 41 has recesses r and cutouts n so that the rubber sheets 71, 71, the upper flange 72 and the lower flange 73 can be placed. The lower flange 73 has a plurality of screw holes 73*s* defined therein.

As shown in FIG. 9, the two rubber sheets 71 are placed vertically so as to sandwich the central member 41C of the drive ring 41, and the upper flange 72 and the lower flange 73 are placed so as to sandwich the rubber sheets 71, and then all the components are fastened together by a plurality of bolts 48 which fix the guide shaft 58 using the screw holes 73*s* formed in the lower flange 73. Thus, the guide shaft 58, the upper flange 72, and the lower flange 73 are fixed to the drive ring 41 with the rubber sheets 71 interposed between the upper flange 72, the lower flange 73, and the central member 41C. When vibrations from the retaining ring 40 are transmitted through the drive ring 41 to the guide shaft 58, the vibrations are damped by the rubber sheets 71. Consequently, vibrations of the top ring in its entirety are reduced.

Figure 10:
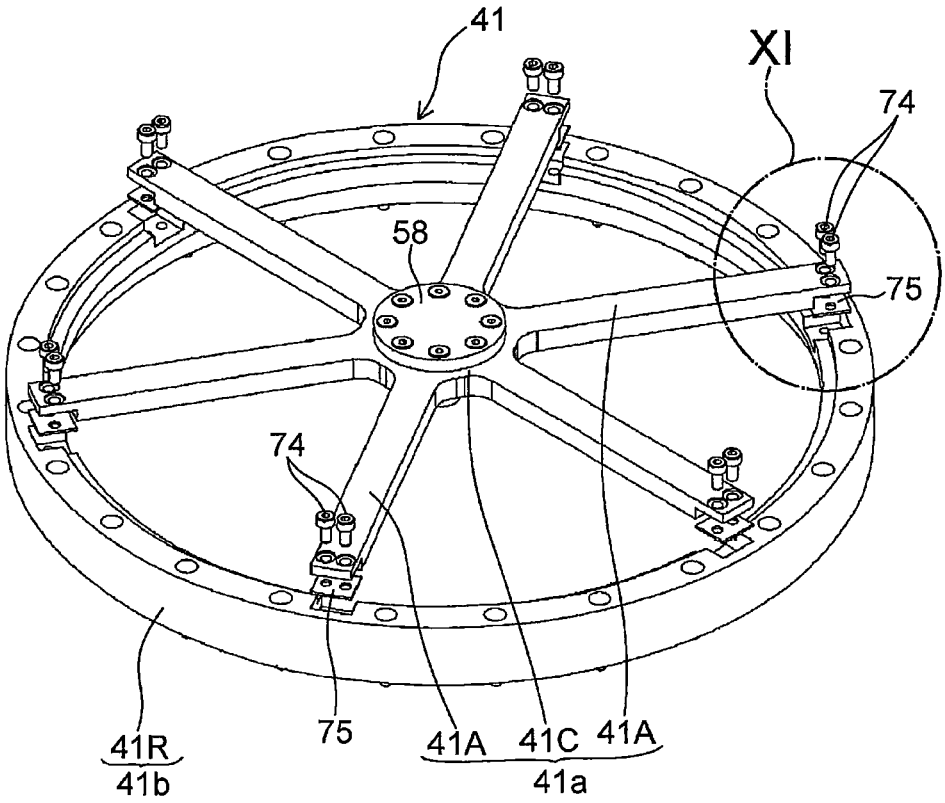
FIG. 10 is a view showing a drive ring according to a third embodiment.
Figure 11A:
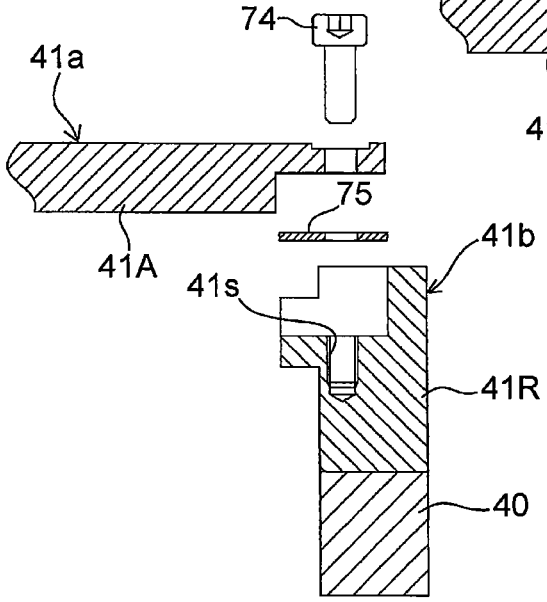
FIGS. 11A and 11B are views showing the drive ring according to the third embodiment, and enlarged views of a portion XI in FIG. 10.
Figure 11B:
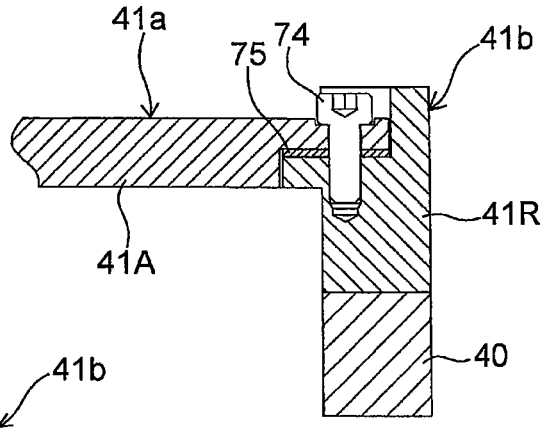

FIGS. 10, 11A and 11B are views showing a drive ring 41 according to a third embodiment, and FIG. 10 is an exploded perspective view of the drive ring 41 and FIGS. 11A and 11B are enlarged views of a portion XI in FIG. 10. According to the third embodiment, the drive ring 41 is divided into a central section 41*a* and a ring section 41*b*, and rubber sheets are placed at the connecting portion of the central section 41*a* and the ring section 41*b* as with the first embodiment.

As shown in FIG. 10, the drive ring 41 is divided into the central section 41*a* and the ring section 41*b*. The central section 41*a* is composed of a central member 41C and a plurality of connecting arms 41A, and the plural connecting arms 41A of the central section 41*a* extend radially outwardly to an annular portion of the ring section 41*b*. The ring section 41*b* comprises a ring member 41R alone. Rubber sheets 75 are disposed between the radially outer ends of the connecting arms 41A and the ring member 41R. A plurality of bolts 74 are provided above the end of each of the connecting arms 41A.

FIG. 11A shows the state before the central section 41*a* and the ring section 41*b* are connected to each other, and FIG. 11B shows the state in which the central section 41*a* and the ring section 41*b* are connected to each other.

As shown in FIG. 11A, the rubber sheet 75 is provided between the radially outer end of the connecting arm 41A of the central section 41*a* and the ring member 41R of the ring section 41*b*. The bolts 74 are provided above the radially outer end of the connecting arm 41A of the central section 41*a*. The ring member 41R has a plurality of screw holes 41*s* defined therein.

As shown in FIG. 11B, the radially outer ends of the connecting arms 41A of the central section 41*a* are fastened to the ring member 41R of the ring section 41*b* by the plural bolts 74, and thus the drive ring 41 is integrated and the rubber sheets 75 are sandwiched between the radially outer ends of the connecting arms 41A and the ring member 41R. Thus, when vibrations from the retaining ring 40 are transmitted through the drive ring 41 to the guide shaft 58, the vibrations are damped by the rubber sheets 75. Consequently, vibrations of the top ring in its entirety are reduced.

According to the first and third embodiments of the drive ring, the drive ring 41 comprises a two-split structure composed of the central section 41*a* and the ring section 41*b*, and the rubber sheets 67, 75 are interposed at the connecting portion of the central section 41*a* and the ring section 41*b* which are integrated by fasteners such as bolts. Specifically, the central section 41*a* and the ring section 41*b* comprise a first material having a high level of rigidity and a large modulus of longitudinal elasticity, e.g., a metal such as stainless steel, resin such as engineering plastics, ceramics, or the like. The central section 41*a* and the ring section 41*b* are connected to each other through a second material, comprising the rubber sheets 67, 71, having a modulus of longitudinal elasticity smaller than the first material. The rubber sheet is made of EPDM, fluororubber, nitrile rubber, urethane rubber, silicone rubber, or synthetic rubber with an increased damping capability. That is, the drive ring 41 comprises a first material, and a second material having a modulus of longitudinal elasticity smaller than the first material.

According to the second embodiment of the drive ring, the rubber sheets 71 are disposed between the drive ring 41 and the guide shaft 58 which couples the drive ring 41 to the spherical bearing 55 disposed centrally in the top ring body 10 (specifically, the central part of the carrier 44). Specifically, the drive ring 41 comprises a first material having a high level of rigidity and a large modulus of longitudinal elasticity, e.g., a metal such as stainless steel, resin such as engineering plastics, ceramics, or the like. The drive ring 41 is coupled to the guide shaft 58 through a second material, comprising the rubber sheets 71, having a modulus of longitudinal elasticity smaller than the first material. The rubber sheet is made of EPDM, fluororubber, nitrile rubber, urethane rubber, silicone rubber, or synthetic rubber with an increased damping capability. The rubber sheets 71 may be separated from the drive ring 41 as shown in FIG. 8. Alternatively, the rubber sheets 71 may be formed integrally with the central member 41C of the drive ring 41 by rubber mold. Consequently, in the second embodiment also, the drive ring 41 comprises a first material, and a second material having a modulus of longitudinal elasticity smaller than the first material.

According to the first through third embodiments of the drive ring, since the drive ring 41 comprises a first material, and a second material having a modulus of longitudinal elasticity smaller than the first material, vibrations generated in the retaining ring during polishing are damped by the second material when the vibrations are transmitted from the first material to the second material of the drive ring. Therefore, the vibrations that are transmitted from the retaining ring through the drive ring to the top ring body can be damped, and hence vibrations of the top ring in its entirety can be damped. Accordingly, vibrations of the top ring in its entirety can be reduced.

Although the embodiments of the present invention have been describe above, it should be noted that the present invention is not limited to the above embodiments, but may be reduced to practice in various different embodiments within the scope of the technical concept of the invention.

What is claimed is:

1. A substrate holding apparatus comprising:

a top ring body having a substrate holding surface configured to hold and press a substrate against a polishing surface;

a retaining ring configured to surround the substrate and to contact the polishing surface; and a drive ring comprising a ring member configured to hold the retaining ring on a lower surface thereof, a central member disposed at a central part of the top ring body and supported by the top ring body, and a connecting portion configured to connect the ring member and the central member;

wherein the drive ring comprises a first material and a second material having a modulus of longitudinal elasticity smaller than the first material; and wherein the retaining ring is configured to be vertically movable and to be tiltable independently of the top ring body.

2. The substrate holding apparatus according to claim 1, wherein the second material comprises a rubber material.

3. The substrate holding apparatus according to claim 2, wherein the rubber material comprises one of EPDM, fluororubber, nitrile rubber, urethane rubber, silicone rubber, and synthetic rubber with an increased damping capability.

4. The substrate holding apparatus according to claim 2, wherein the rubber material comprises a molded rubber material.

5. A substrate holding apparatus comprising:

a top ring body having a substrate holding surface configured to hold and press a substrate against a polishing surface;

a retaining ring configured to surround the substrate and to contact the polishing surface;

a drive ring comprising a ring member configured to hold the retaining ring on a lower surface thereof, a central member disposed at a central part of the top ring body and supported by the top ring body, and a connecting portion configured to connect the ring member and the central member;

wherein the drive ring comprises a first material and a second material having a modulus of longitudinal elasticity smaller than the first material; and wherein the connecting portion comprises a plurality of connecting arms.

6. The substrate holding apparatus according to claim 5, wherein the connecting portion of the connecting arm has a shape configured to compress the rubber material provided between surfaces of the connecting portion so as to receive tensile, compressive, shearing, and bending loads applied thereto.

7. The substrate holding apparatus according to claim 5, wherein the drive ring is supported so that the drive ring is capable of tilting and vertically moving, by a guide shaft connected to the central member of the drive ring, and a spherical bearing disposed at the central part of the top ring body; and each of the connecting arms is sandwiched between a pair of rollers supported on a carrier holding a membrane so that movement of the drive ring in a rotational direction is restricted.

8. A polishing apparatus comprising:

a substrate holding apparatus according to claim 1; and a polishing table configured to support a polishing pad having a polishing surface.

9. A substrate holding apparatus comprising:

a top ring body having a substrate holding surface configured to hold and press a substrate against a polishing surface;

a retaining ring configured to surround the substrate and to contact the polishing surface; and a drive ring comprising a ring member configured to hold the retaining ring on a lower surface thereof, a central member disposed at a central part of the top ring body and supported by the top ring body, and a plurality of connecting arms configured to connect the ring member and the central member;

wherein the drive ring comprises a central section including the central member and the plurality of connecting arms, and a ring section comprising the ring member, the central section and the ring section being connected to each other by fasteners; or the drive ring comprises a central section including the central member and radially inner portions of the connecting arms, and a ring section including radially outer portions of the connecting arms and the ring member, the central section and the ring section being connected to each other by fasteners.

10. The substrate holding apparatus according to claim 9, wherein the central section comprises a first material; and a portion comprising a second material having a modulus of longitudinal elasticity smaller than the first material is provided at the connecting portion of the central section and the ring section.

11. The substrate holding apparatus according to claim 9, wherein a rubber material is provided at the connecting portion of the central section and the ring section.

12. The substrate holding apparatus according to claim 11, wherein the rubber material comprises one of EPDM, fluorubber, nitrile rubber, urethane rubber, silicone rubber, and synthetic rubber with an increased damping capability.

13. The substrate holding apparatus according to claim 11, wherein the rubber material comprises a molded rubber material.

14. The substrate holding apparatus according to claim 11, wherein the connecting portion of the connecting arm has a shape configured to compress the rubber material provided between surfaces of the connecting portion so as to receive tensile, compressive, shearing, and bending loads applied thereto.

15. The substrate holding apparatus according to claim 9, wherein the drive ring is supported so that the drive ring is capable of tilting and vertically moving, by a guide shaft connected to the central member of the drive ring, and a spherical bearing disposed at the central part of the top ring body; and each of the connecting arms is sandwiched between a pair of rollers supported on a carrier holding a membrane so that movement of the drive ring in a rotational direction is restricted.

16. A polishing apparatus comprising:

a substrate holding apparatus according to claim 9; and a polishing table configured to support a polishing pad having a polishing surface.

17. A substrate holding apparatus comprising:

a top ring body configured to hold and press a substrate against a polishing surface;

a retaining ring configured to surround the substrate and to contact the polishing surface; and a drive ring comprising a ring member configured to hold the retaining ring on a lower surface thereof, a central member disposed at a central part of the top ring body and supported by the top ring body, and a plurality of connecting arms configured to connect the ring member and the central member;

wherein the central member comprises a first material; and a portion comprising a second material having a modulus of longitudinal elasticity smaller than the first material is provided between the central member of the drive ring and a guide shaft fixed to the central member of the drive ring and inserted in a bearing provided in the top ring body.

18. The substrate holding apparatus according to claim 17, wherein the second material comprises a rubber material.

19. The substrate holding apparatus according to claim 18, wherein the rubber material comprises one of EPDM, fluororubber, nitrile rubber, urethane rubber, silicone rubber, and synthetic rubber with an increased damping capability.

20. The substrate holding apparatus according to claim 18, wherein the rubber material comprises a molded rubber material.

21. The substrate holding apparatus according to claim 17, wherein the drive ring is supported so that the drive ring is capable of tilting and vertically moving, by a guide shaft connected to the central member of the drive ring, and a spherical bearing disposed at the central part of the top ring body; and each of the connecting arms is sandwiched between a pair of rollers supported on a carrier holding a membrane so that movement of the drive ring in a rotational direction is restricted.

22. A polishing apparatus comprising:

a substrate holding apparatus according to claim 17; and a polishing table configured to support a polishing pad having a polishing surface.

* * * * *